US005868192A

United States Patent [19]

Rabinovich

[11] Patent Number: 5,868,192

[45] Date of Patent: Feb. 9, 1999

[54] METHOD OF CASTING BANGLE PARTS

[76] Inventor: Eduard Rabinovich, 222-42 77th Ave., Bayside, N.Y. 11364

[21] Appl. No.: 822,547

[22] Filed: Mar. 19, 1997

[51] Int. Cl.[6] ..... B22C 7/02; B22C 9/04; B22D 18/06; B22D 25/00

[52] U.S. Cl. ..... 164/34; 164/35; 164/45; 164/63

[58] Field of Search ..... 164/34, 35, 45, 164/63; 63/7, 8, 9

[56] References Cited

U.S. PATENT DOCUMENTS

| | | | |
|---|---|---|---|
| 1,591,815 | 7/1926 | Girdany . | |
| 2,790,220 | 4/1957 | Fox . | |
| 3,402,755 | 9/1968 | Christian | 164/35 |
| 3,601,178 | 8/1971 | Marticorena | 164/45 |
| 3,780,787 | 12/1973 | Rasmussen | 164/35 |
| 4,114,238 | 9/1978 | Powell | 16/157 |
| 4,154,282 | 5/1979 | Kull | 164/9 |
| 4,246,954 | 1/1981 | Cohen et al. | 164/35 |
| 4,283,831 | 8/1981 | Jhono | 29/423 |
| 4,392,289 | 7/1983 | Michaud | 29/160.6 |
| 4,630,346 | 12/1986 | Singer | 29/160.6 |
| 4,793,045 | 12/1988 | Singer | 29/160.6 |
| 5,066,213 | 11/1991 | Ferincz | 164/45 X |

*Primary Examiner*—J. Reed Batten, Jr.
*Attorney, Agent, or Firm*—Steven Horowitz

[57] ABSTRACT

The investment casting method uses the lost wax method and involves using a model to form a wax piece in the desired shape such as the shape of the snap element or the shape of two hinge halves, making a tree out of a multitude of the wax pieces, adding slurry and heating to create hard material having spaces shaped like the wax parts and then pouring molten casting material into the spaces in a vacuum environment.

2 Claims, 5 Drawing Sheets

FIG. 1
PRIOR ART
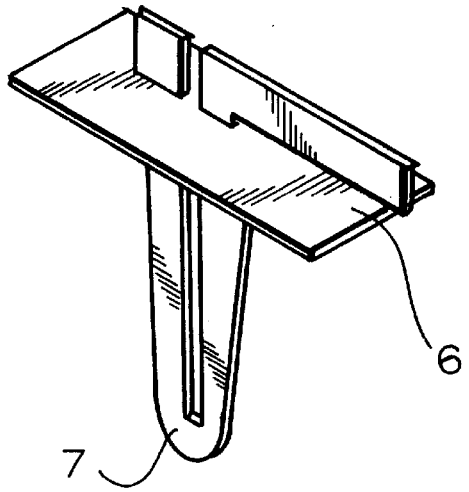
FIG. 2C
PRIOR ART
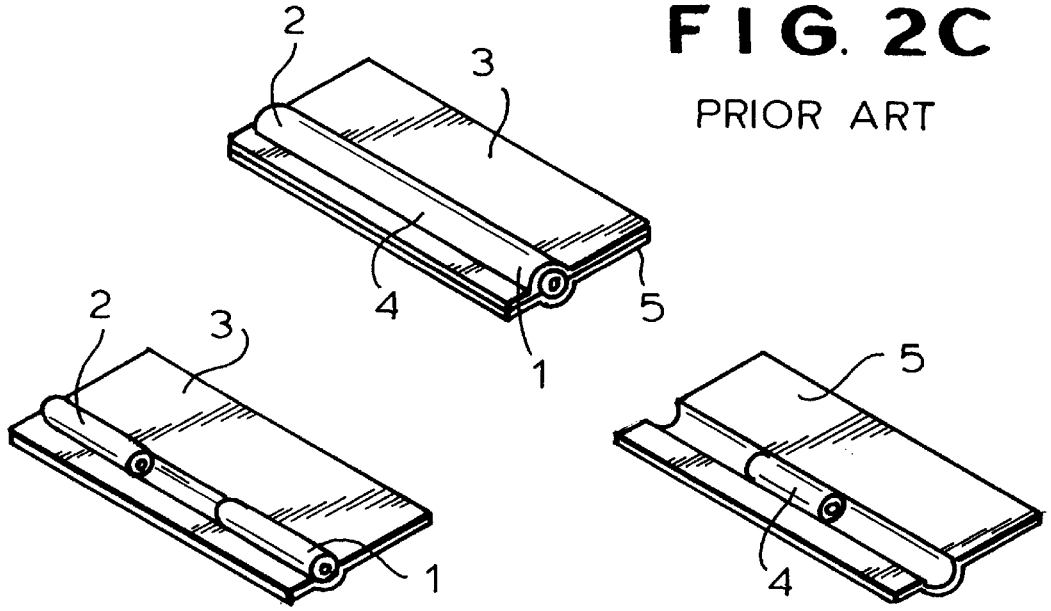
FIG. 2A
PRIOR ART
FIG. 2B
PRIOR ART

METHOD OF CASTING BANGLE PARTS

FIELD OF THE INVENTION

This invention relates to a new method of manufacturing jewelry, in particular bangles, and is directed to a new method involving investment casting of the hinge and snaps of the bangles and a new method of assembling the components of the bangles.

BACKGROUND

There is a particular kind of jewelry called bangles, which can be described as bracelets made of a ring of metal such as gold or gold plated alloy. Bangles generally consist of two ornamental roughly identical semi-circular gold-plated metallic rings. The rings snap together at one end and are hinged together at another end by means of a hinge or joint. The snap element opens and closes and snaps together at one end of each semi-circular ring.

DESCRIPTION OF THE PRIOR ART

While the semi-circular rings of the bangles are often made by any of various casting methods known in the art, the snap elements and the hinges of the bangles are typically made by an expensive and inefficient method of metal pressing well known in the art. An example of this type of method is U.S. Pat. No. 4,114,238 to Powell for a "Hinge for Jewelry and the Like".

The present method of making the snap elements and the hinges for bangles from metal pressings has several important disadvantages. The main such disadvantage is the expensive nature of this process. As a result only large companies can possibly afford to manufacture bangles. For example, there is special equipment needed to manufacture bangles using this method and that special equipment is quite expensive, over $100,000. In particular, a special snap and hinge pressing machine as well as a special soldering machine are examples of the special equipment that necessitates the significant outlay for any potential bangles manufacturer and hence explains the simple fact that only large companies presently manufacture bangles. The reason that soldering machines are needed when using present methods of making bangles is that these methods make use of metal pressing several different pieces, for example with respect to the hinge of the bangle, that are only afterwards combined into one hinge piece.

Another important disadvantage is the cumbersome, inefficient and time-consuming method needed to make the bangles. For example, in order to make the hinge using known methods it is necessary to drill the bangle besides inserting it and soldering. Similarly, to make the snap element it is necessary to insert the snap element into the semi-circular rings, to solder the snap element on and then to cut down the excess snap element by filing it with special drill. As a result of this cumbersome and inefficient method there are extensive labor costs in filing the excess snap element. Furthermore, this method obviously causes a great deal of scrap metal alloy that remains from the filing off of the snap element and from the drilling of the bangle for insertion of the hinge. Since the metal involved may very well be an alloy of gold, and since the reuse of scrap gold upon melting it causes an inevitable and significant loss of gold, the need to file down the excess snap element and to drill the bangle for insertion of the hinge are worrisome disadvantages. In particular, gold scrap is sold at approximately 95%–97% of the value of pure gold because of the need to refine the gold scrap.

Still another disadvantage of the present method of pressing the snap and hinge and assembling the elements is the fact that the hinge is actually itself made of five separate pieces and the snap element is itself made from three separate pieces. This increases the time, labor and expense involved in making the snaps and hinges for each bangle and in assembling the parts together to complete the bangle.

Notwithstanding these debilitating and expensive disadvantages that have been well known for numerous decades, if not centuries, and which have limited the potential manufacturers of bangles to large companies, this method of making bangles by metal pressing the hinges and snap elements has not been significantly improved in a long time.

Investment casting is a known method of making metallic forms for jewelry. For example, U.S. Pat. No. 3,780,787 to Rasmussen discloses a method of making castings according to the wax elimination method. It is not known, however, to use investment casting to make the snaps and hinges of bangles. Instead the much more cumbersome and expensive method described above has been used over a very long period of time.

Although the manufacture of bangles, and in particular the manufacture of snaps and hinges for bangles, have been around for not just decades but probably centuries, it is not known in the art to use any kind of investment casting in order to make the snaps and hinges for bangles. The present invention discloses a method of using investment casting for the snaps and hinges of bangles and discloses a new method of assembling the elements of the bangles that are made by this method of investing casting.

The new method of making snaps and hinges and assembling them in accordance with the present invention overcomes all of the disadvantages of the prior art and results in bangles that are equal or better in quality. Specifically, the new method of the present invention also saves time and money - and time and money are everything in manufacturing.

OBJECTS AND ADVANTAGES

The following important objects and advantages of the present invention are:

(a) to provide a method of manufacturing bangles that makes use of investment casting of the hinge and snap elements of the bangles, (b) to provide a method of manufacturing the hinge and snap elements of the bangles that is close to eighty per cent less expensive overall, (c) to provide a method of manufacturing hinges of bangles hinge from only two pieces instead of five and a method of manufacturing snap elements of bangles from one piece, a portion of which is broken off during assembly, instead of three.

(d) to provide a method of manufacturing the hinge and snap elements of the bangles that requires only a few thousand dollars of equipment instead of approximately one hundred thousand dollars of equipment, (e) to provide a method of manufacturing the hinge and snap elements of the bangles that only requires inserting and soldering the snap elements and obviates the need to file down the snap element before its insertion into the semi-circular bangle ring and which begins from a more accurate mold thus cutting the amount of gold scrap in half and cutting in half also the losses incurred from melting the gold and from selling the scrap gold at a discounted price, and (f) to provide a method of manufacturing the hinge and snap elements of the bangles that only requires inserting and soldering the bangle rings before insertion of the hinge into the rings and that obviates the need to file down the snap element before its insertion into the semi-circular bangle ring thus reducing lost gold scrap by seventy per cent, and (g) to provide a method of manufacturing the hinge and snap elements of the bangles wherein it is easy to insert the snap element and hinge into the semi-circular rings and the overall productivity of manufacturing the bangles is greatly enhanced.

BRIEF DESCRIPTION OF THE DRAWINGS

FIG. 1 is a perspective view of a snap element for bangles made by the prior art method of metal pressing.

FIG. 2A is a perspective view of a portion of a hinge half for bangles made by the prior art method of metal pressing.

FIG. 2B is a perspective view of a portion of a second half of a hinge for bangles made by the prior art method of metal pressing.

FIG. 2C is a perspective view of a hinge for bangles made by the prior art method of metal pressing.

DETAILED DESCRIPTION OF THE PREFERRED EMBODIMENT

Figure 3:
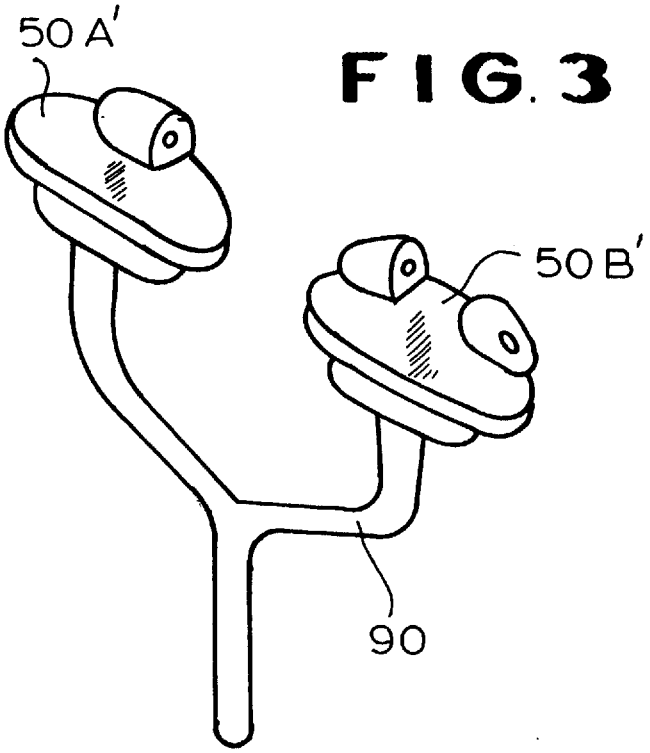
FIG. 3 is a perspective view of a wax mold of the two hinge halves used for a wax tree.

Bangle 10 (see FIGS. 8A, 8B) is generally composed of two ornamental roughly identical semi-circular gold-plated metallic rings 11, 12. The rings 11, 12 snap together at one end and are hinged together at another end by means of a hinge 50 or joint. The snap element 40 opens and closes and snaps together at one end of each semi-circular ring by means of tongue 44 which, as explained below, is added on and soldered to snap element 40 at the end of the assembly of the bangle.

Investment Casting Method for Snap Element and Hinge

The following method involves investment casting using the lost wax method and describes in detail how snap elements 40 are made in accordance with the method of the present invention. This casting method is applicable to and is used in accordance with the present invention in the manufacture of the hinge of the bangle. Accordingly, the term "snap element" 40 could just as well be replaced with the term "hinge" 50 and the method will remain the same. The only difference, as described below, is the hardness of the alloy used—i.e. the snap element requires a harder alloy and of course the shape of the initial model.

The starting point of the investment casting method of the present invention is an accurate snap element 40 (and similarly, a hinge 50) that may have been made from metal pressings or by the method of the present invention so that it can be used as a model of a snap element 40.

Step One of the investment casting method is to create a wax version of the snap element 40 from the metal alloy model snap element. This is done by first placing the model of snap element 40 into a special malleable rubber material and then cutting the rubber around the model in order to begin creating a rubber mold. An example of the rubber material used for the rubber mold is the product brand sold under the name "Gold Label" made by a company called Castaldo. The rubber with the model of the snap element 40 is then placed into a vulcanizer machine and heated for approximately one half hour. When it cools and the model of the snap element is removed manually (the rubber is cut by tool) the rubber mold has a grooved space or indentation within it exactly in the shape of the snap element 40. This procedure is repeated—the same individual model of the snap element is placed into hundreds of pieces of rubber material. Accordingly, hundreds of pieces of rubber having a space in the form of the snap element 40 are produced.

Then, using a special wax injector, you inject soft fluent hot wax into the space inside each of the rubber molds. When the wax hardens the wax is in the shape of the snap element and is then removed manually from the rubber mold. Hundreds of these snap elements 40 made of wax are thus produced at the same time.

Figure 6:
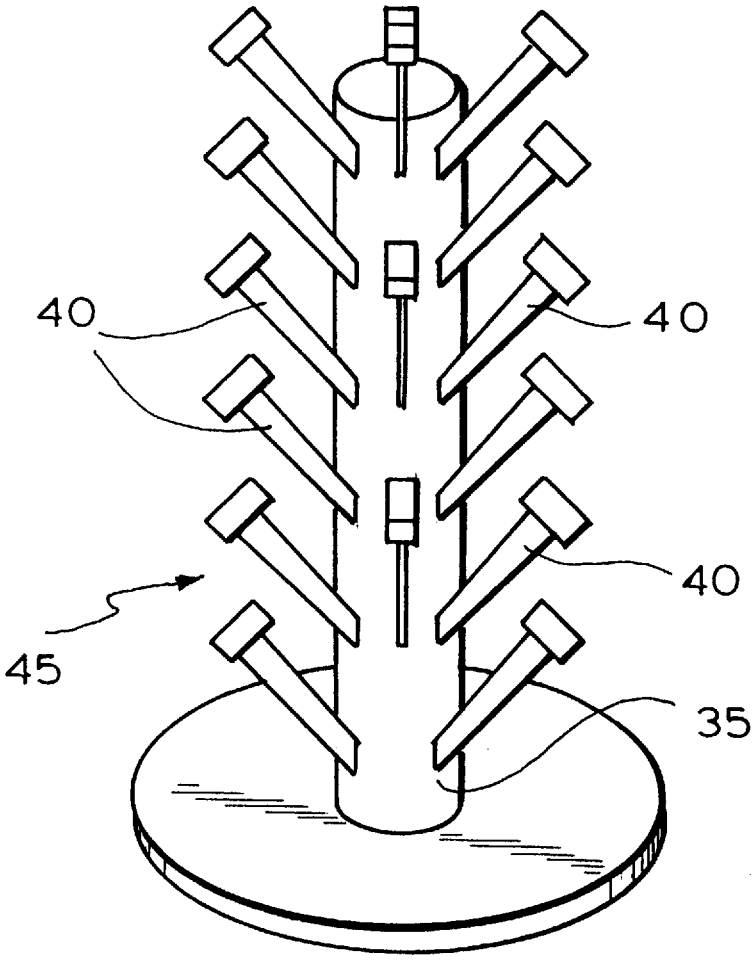
FIG. 6 is a perspective view of a wax tree of bangle snap elements made in accordance with the methods of the present invention.

Step Two involves creating a wax tree 45 as shown in FIG. 6. Dozens of snap elements 40 made of wax are stuck into a wax trunk 35 of a tree stand 32. This is done manually.

In Step Three the wax tree 45 is then placed into a large flask. The flask is filled with a slurry consisting primarily of crystalline silica powder and water. The water represents somewhat less than 50 per cent by volume of the slurry mixture. Place the flask in an industrial oven for a few hours so that the slurry hardens and the wax either drips out or evaporates leaving spaces exactly in the shape of where the wax was. Then insert the flask (usually upside down) into a vacuum container and pour the desired molten gold alloy or other casting material into the container causing the gold alloy to be sucked into the spaces where the wax was. When the gold alloy cools you have gold snap elements that just have to be removed from the trunk 35 which is now gold by any well known methods such as water pressure.

For the snap element 40 the gold alloy must be hard enough to function properly as a snap element. An example of such an alloy is spring alloy no. 320 sold by United Precious Metals, a company based in 2781 Town Line Road, Alden, N.Y. 14004.

Only a minimal amount of gold is lost in the soldering process for the snap element because the original mold is much more accurate than that used at the beginning of the metal pressing process and because no drilling is needed using this method, in contrast to the methods of the prior art.

Figure 4A:
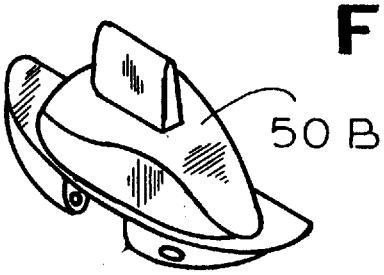
FIG. 4A is a perspective view of one half of a hinge for bangles made in accordance with the method of the present invention.
Figure 4B:
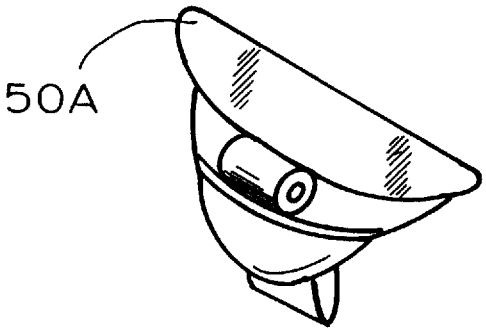
FIG. 4B is a perspective view of a second half of a hinge for bangles made in accordance with the method of the present invention.
Figure 7:
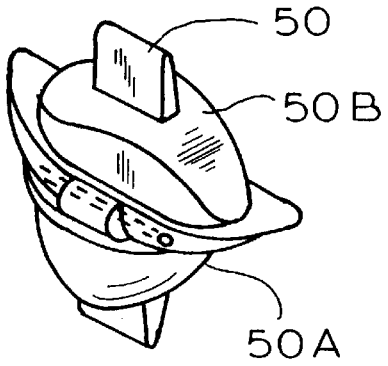
FIG. 7 is a perspective view of an assembled hinge made in accordance with the method of the present invention.

The snap elements 40 and the hinges 50 are made the same way. The snap element 40 is made of one piece which is then cut into two pieces before insertion. Similarly, as seen in FIGS. 3, 4A, 4B, both halves 50A', 50B' of hinge 50 are simultaneously made by casting, as seen in FIG. 3, and then the trunk 90 is cut off the resulting hinge piece to obtain the hinge halves of FIGS. 4A, 4B which are fitted together into the assembled hinge 50 seen in FIG. 7. The casting of the hinge employs a regular soft casting alloy of gold, in contrast to the hard alloy of the snap material snap is constantly opened and closed.

Assembly Into a Bangle

Figure 8A:
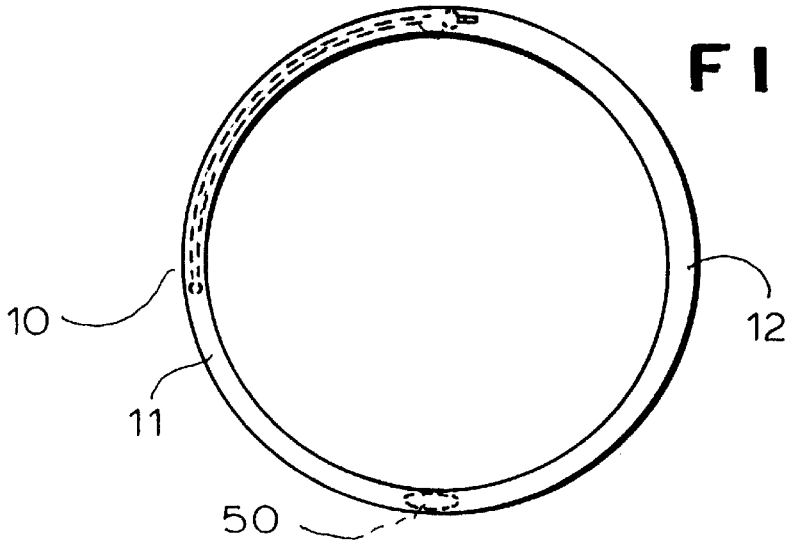
FIG. 8A is a side elevational view of the entire bangle with the snap element and hinge inserted in closed condition.
Figure 8B:
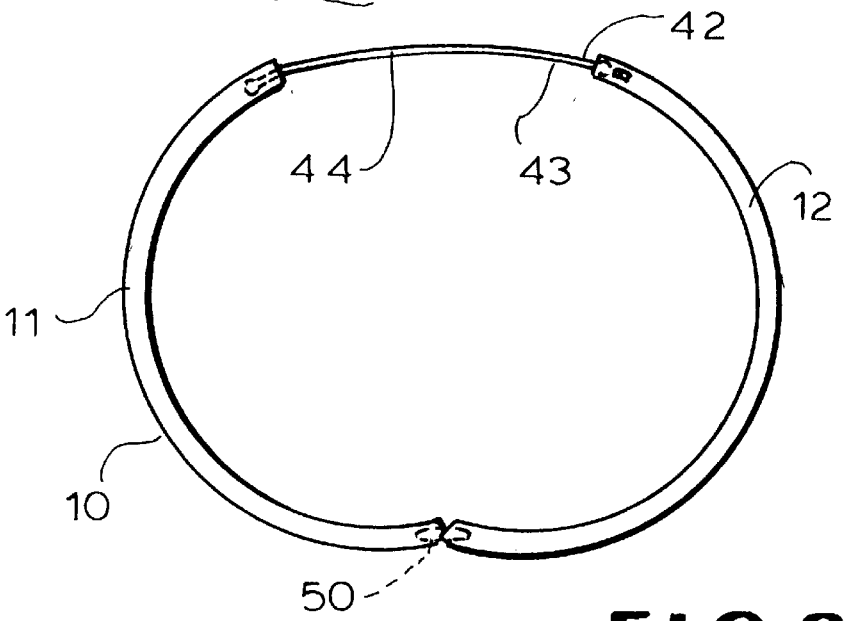
FIG. 8B is a side elevational view of the entire bangle with the snap element and hinge inserted in open condition.

Once made by the above method, each hinge half 50*a*, 50*b* is joined together to make one hinge 50 and then inserted into two ends of two different semi-circular bangle ring 11, 12 as seen in FIGS. 8A, 8B. The hinge 50 is then soldered to the ends of each of the two rings 11, 12. Then a wire pin is inserted in the hinge 50 to lock it. Only a minimal amount of gold is lost in the soldering process because the original mold is much more accurate than that used at the beginning of the metal pressing process and because no drilling is needed using this method, in contrast to the methods of the prior art. As a result of this process each semi-circular ring 11, 12 retains only one free end available for insertion of the parts of snap element 40.

Figure 5A:
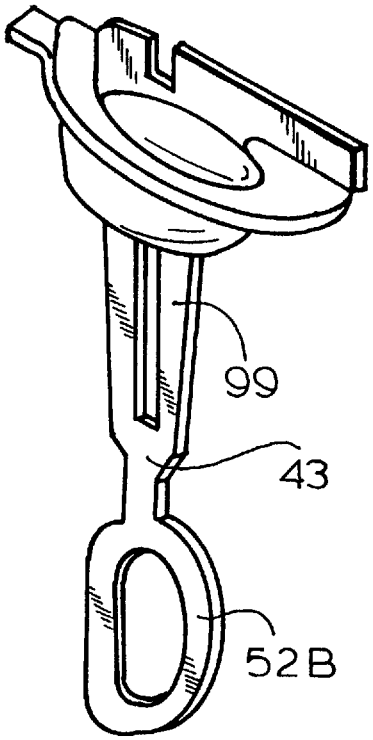
FIG. 5A is a perspective view of a snap element for bangles made in accordance with the present invention.
Figure 5B:
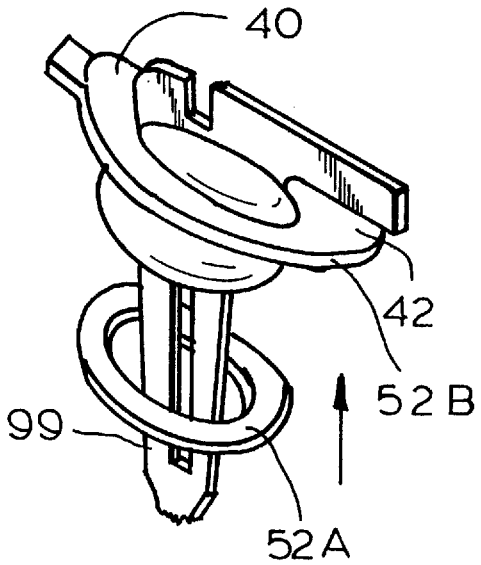
FIG. 5B is a perspective view of the snap element of FIG. 5A after a loop element is cut off and positioned on the remainder of the snap element.

In accordance with the method of the present invention, after the snap element 40 is manufactured by the investment casting method of the present invention, it is cut at point 43 into two parts, as seen in FIGS. 5A and 5B. That is, loop element 52A is deleted from snap element 40 and the remainder is irregularly shaped member 42 as seen in FIG. 5B. Once cut off, loop element 52A is fitted onto the protruding end 99 of irregularly shaped member 42.

Each end of irregularly shaped snap element member 42 is then inserted into the free end of one of the semi-circular rings 11, 12 and the semi-circular rings 11, 12 are closed together. At that point the loop elements 52A, 52B and adjacent the respective ends of the semi-circular rings 11, 12. Each loop element 52A, 52B is soldered to the end it is adjacent to. The protruding end 99 of the irregularly shaped member 42 is able to move freely within a semi-circular ring 11 or 12. At that point, when the entire bangle has been assembled, tongue 44 is added on and soldered to snap element 40 the point 43 where loop element 52A was cut off. Tongue 44 is curved so that it can be fitted into a hole in a free end of one of the semi-circular rings 11 and cannot come out of ring 11 because of bulge 44*a* is blocked by additional soldering at the end of the ring 11 diminishing the opening at the end of ring 11. This tongue 44 allows the semi-circular rings 11, 12 to open and to snap into each other when closing. The snapping action arises from bulge 44*a* located at that end of tongue 44 opposite to the end that was soldered to snap element 40.

Only a minimal amount of gold is lost in the soldering process in contrast to the methods of the prior art. No drilling is needed in contrast to the methods of the prior art.

By the above method, the bangle can be easily assembled from only four pieces and two ring elements. In fact, only three pieces have to be casted (two parts 50*a*, 50*b* for the hinge 50 and one for snap element 40) since the snap element 40 is cast as one whole piece and then cut into two parts only afterwards.

As should now be appreciated from the above description and by reference to the drawings, it is much less expensive to manufacture bangles using the method of the present invention. Under the method of the present invention the equipment needed to manufacture the bangles costs only a few thousand dollars instead of approximately one hundred thousand dollars. Moreover, the two or three thousand dollars in needed equipment is for equipment that is not limited to the manufacture of bangle parts but can be used for manufacturing pieces other than the snaps 40 and hinges 50 of bangles. Accordingly, the actual cost of this equipment attributable to the manufacture of bangles should be considered even less than two to three thousand dollars.

In manufacturing, the cost of the manufacturing process is everything. If manufacturing costs can be reduced by as much as eighty per cent, as it can be from the method of the present invention, that can revolutionize the availability of a product and significantly reduce its cost to the public.

In addition, it is significantly easier to manufacture bangles using the method of the present invention. Once the snap element 40 and hinge 50 have been manufactured in accordance with the method of the present invention, by using the method of assembly of the present invention it is much easier to connect the snap 40 and the hinge 50 to semi-circular rings 11, 12 in order to create the finished bangle 10. Instead of costing approximately one dollar to insert the hinge 50 into the semi-circular ring members 11, 12 and to insert the snap element 40 into the semi-circular ring members 11, 12, it only costs approximately seventy five cents per bangle to do the same thing.

Furthermore, instead of having to drill the bangle 10 to prepare for the insertion of the hinge 50 after it is made, which results in a significant loss of gold alloy (from melting the scrap gold into usable gold) and involves much labor, it is only necessary using the present invention to insert the hinge 50 into the semi-circular rings 11, 12 and to solder it in. No drilling is necessary. Likewise, with respect to the snap element, instead of having to having to insert it, solder it and then cut it by filing it down with a special drill, a process involving high labor cost and loss of gold (from melting the scrap gold into usable gold) it is only necessary with the present invention to insert the snap element 40 and solder it in. No drilling is needed. As a result, a comparison of the manufacturing method of the present invention with the prior art method, reveals that there is approximately a seventy per cent reduction in the amount of scrap gold generated, an important factor since when you melt scrap gold a great deal of it is lost.

Furthermore, using the new method of the present invention the total number of pieces that have to be assembled and soldered is reduced. With respect to the prior art version of hinge 50, for example, as seen by reference to FIGS. 2A, 2B and 2C, instead of a total of five pieces needed to be manufactured and assembled as per the metal pressing method of the prior art, only two pieces are needed. The prior art hinge of FIG. 2C is made by combining parts 1, 2, 3 of FIGS. 2A and parts 4, 5 of FIG. 2B. This is done by soldering together parts 1, 2 and 3 of FIG. 1A to each other. Then parts 4 and 5 are soldered together to create FIG. 1B. Then FIGS. 1*a* and 1B are combined together to create FIG. 1C. With the methods of the present invention, the task of metal pressing the five component parts of FIGS. 1A and 1B and then soldering the five parts into the two hinge halves of FIGS. 1A and FIG. 1B is entirely eliminated. Therefore, no soldering equipment is even needed.

Similarly, with respect to snap element 40, in contrast to the present invention, the prior art snap element of FIG. 1 requires metal pressing parts 6 and 7 and then soldering these parts together to form the prior art snap of FIG. 1. With the present invention, no soldering is needed. Instead, only one piece is manufactured by casting and that piece is then broken into two pieces for assembly, as explained above. Accordingly, without counting the semi-circular ring elements 11, 12, for both the snap and hinge combined, a total of three pieces are manufactured (and a fourth piece is broken off and used) in the new method, in contrast to the total of seven pieces of the prior art method. This itself saves labor and cost. Also, equipment costs are saved from the fact that special soldering equipment is not eliminated.

As a result, productivity is greatly enhanced. It is estimated that using the methods of the present invention in the manufacture of bangle 10, instead of being able to make 100 bangles per day as per the prior art, it is possible to manufacture 200 pieces per day.

All in all, when adding up all the advantages mentioned above for the method of manufacturing and assembling the snap elements 40 and hinges 50 of the bangles 10 in accordance with the present invention and comparing them to the existing method of manufacturing by metal pressing and then assembling the seven pieces with drilling, the total cost savings is enormous and has been estimated to equal approximately seventy to eighty per cent. For example, over the long term, whereas it might cost one dollar and fifty cents to buy one bangle snap element 40 or one bangle hinge 50, and it might cost approximately one dollar to manufacture the snap element 40 or hinge 50 oneself, under the new methods of the present invention, it would cost only twenty cents to manufacture one bangle snap 40 or one bangle hinge 50.

Although the invention has been described in detail in the foregoing specification along with the accompanying drawing with respect to various embodiments thereof, these are intended to be illustrative only and not limiting. One skilled in the art will recognize that various modifications and variations may be made therein which are within the spirit of the invention and the scope of the appended claims.

What is claimed is:

1. A method of making snap elements of bangles having a hinge joining two semi-circular rings and having a snap element, comprising the steps of:

placing a model of the snap element into a malleable rubber material, cutting the rubber material around the model, placing the rubber material with the model of the snap element into a vulcanizer machine and heating for approximately one half hour to form a rubber mold, repeating the above steps to form a plurality of rubber molds, removing the model from each of the rubber molds, injecting soft fluent hot wax into the space inside each of the rubber molds and allowing the wax to harden to form a wax pattern, removing the wax pattern from each of the rubber molds, creating a wax tree by inserting the wax patterns into a wax trunk of a tree stand, placing the wax tree into a large flask and filling the flask with a slurry consisting primarily of crystalline silica powder and water, placing the flask in an industrial oven for a few hours so that the slurry hardens and the wax evaporates and leaves spaces, inserting the flask into a vacuum container and pouring a molten casting material into the container to be sucked into the spaces where the wax patterns were and allowing the casting material to cool to form snap elements, and removing the snap elements from the flask.

2. A method of making hinges of bangles having a hinge joining two semi-circular rings and having a snap element, comprising the steps of:

placing a model containing two halves of a hinge into a malleable rubber material and then cutting the rubber material around the model, placing the rubber material with the model of the two halves of the hinge into a vulcanizer machine and heating for approximately one half hour to form a rubber mold, repeating the above steps to form a plurality of rubber molds, removing the model from each of the rubber molds, injecting soft fluent hot wax into the space inside each of the rubber molds and allowing the wax to harden to form a wax pattern, removing the wax pattern from each of the rubber molds, creating a wax tree by inserting the wax patterns into a wax trunk of a tree stand, placing the wax tree into a large flask and filling the flask with a slurry consisting primarily of crystalline silica powder and water, placing the flask in an industrial oven for a few hours so that the slurry hardens and the wax evaporates and leaves spaces, inserting the flask into a vacuum container and pouring a molten casting material into the container to be sucked into the spaces where the wax patterns were and allowing the casting material to cool to form halves of a hinge, removing the halves of a hinge from the flask.

* * * * *